United States Patent [19]

Kizawa

[11] Patent Number: 4,711,586

[45] Date of Patent: Dec. 8, 1987

[54] CLOCK

[75] Inventor: Hiroyuki Kizawa, Tokyo, Japan

[73] Assignee: Seikosha Co., Ltd., Tokyo, Japan

[21] Appl. No.: 876,373

[22] Filed: Jun. 19, 1986

[30] Foreign Application Priority Data

Jun. 19, 1985 [JP] Japan ..... 60-92484[U]
Jun. 19, 1985 [JP] Japan ..... 60-92485[U]

[51] Int. Cl.[4] ..... G04B 19/06

[52] U.S. Cl. ..... 368/232; 368/228; 368/276; 368/236; 368/314

[58] Field of Search ..... 368/223, 228, 229, 232, 368/234, 236, 276, 309, 314, 316, 327

[56] References Cited

U.S. PATENT DOCUMENTS

| | | | |
|---|---|---|---|
| 1,036,485 | 8/1912 | Greenwald | 368/234 |
| 1,319,044 | 10/1919 | Cohan | 368/236 |
| 3,514,940 | 2/1970 | Keane, Jr. et al. | 368/236 |
| 4,291,401 | 9/1981 | Bachmann | 368/236 |
| 4,362,397 | 12/1982 | Klingenberg | 368/234 |
| 4,459,032 | 7/1984 | Musy | 368/234 |
| 4,472,068 | 9/1984 | Sedlak et al. | 368/234 |

FOREIGN PATENT DOCUMENTS

| | | | |
|---|---|---|---|
| 482923 | 9/1929 | Fed. Rep. of Germany | 368/236 |
| 893410 | 12/1944 | Fed. Rep. of Germany | 368/232 |
| 203477 | 3/1939 | Switzerland | 368/236 |

*Primary Examiner*—Bernard Roskoski
*Attorney, Agent, or Firm*—Bruce L. Adams; Van C. Wilks

[57] ABSTRACT

A clock includes a dial, a transparent cover plate spaced apart from the dial at a certain interval to define a space between the back face of the cover plate and the front face of the dial, and hands disposed in the space and driven to move relative to the dial to indicate time. Spacers are disposed on the visible portion of the front face of the dial and protrude against the back face of the cover plate such that the spacers are contactable with the back face of the cover plate upon deformation of the dial and the cover plate to maintain a sufficient interval of the space to allow face movement of the hands.

20 Claims, 9 Drawing Figures

CLOCK

BACKGROUND OF THE INVENTION

The present invention relates to a clock such as a hanging clock, or the like, and particularly relates to a thin clock.

A clock is well known which is provided with an install plate used also as a back frame, a movement capsule fixedly attached on a back surface of the install plate, a dial disposed in front of the install plate, a transparent front cover fixedly attached to the install plate in front of the dial, and hands disposed between the front cover and the dial and driven by a timepiece movement. A setting shaft for correcting time is disposed on the back side of the install plate.

Recently, a clock has been much desired to be light, thin and small, so that it has been an extremely important technical problem to make the clock thin. Under such circumstances, the distance between the dial and the front cover is made extremely narrow, and, further, the front cover, the dial, the install plate, and even the hands per se have been formed extremely thin to the extent that the strength of the clock is not detrimentally affected.

As the result, the install plate and the front cover have come to be easily deformed due to temperature changes, due to pressure applied in turning the hands, and so on, so as to generate a phenomenon that the front cover touches the hands, especially, a minute hand, so that the minute hand becomes dislodged from a minute hand shaft to thereby stop or, the front cover is rubbed and becomes damaged by the minute hand, or, in the worst case, the clock stops completely.

SUMMARY OF THE INVENTION

An object of the present invention is therefore to provide a clock in which the gap between the front cover and dial can be kept fixed even if the install plate of the movement capsule or the front cover is made to be deformed.

The present invention is featured in that spacers for keeping a gap between the dial and the front cover are provided at positions corresponding to time reference positions so as to act as reference members.

DETAILED DESCRIPTION OF PREFERRED EMBODIMENTS

Figure 1:
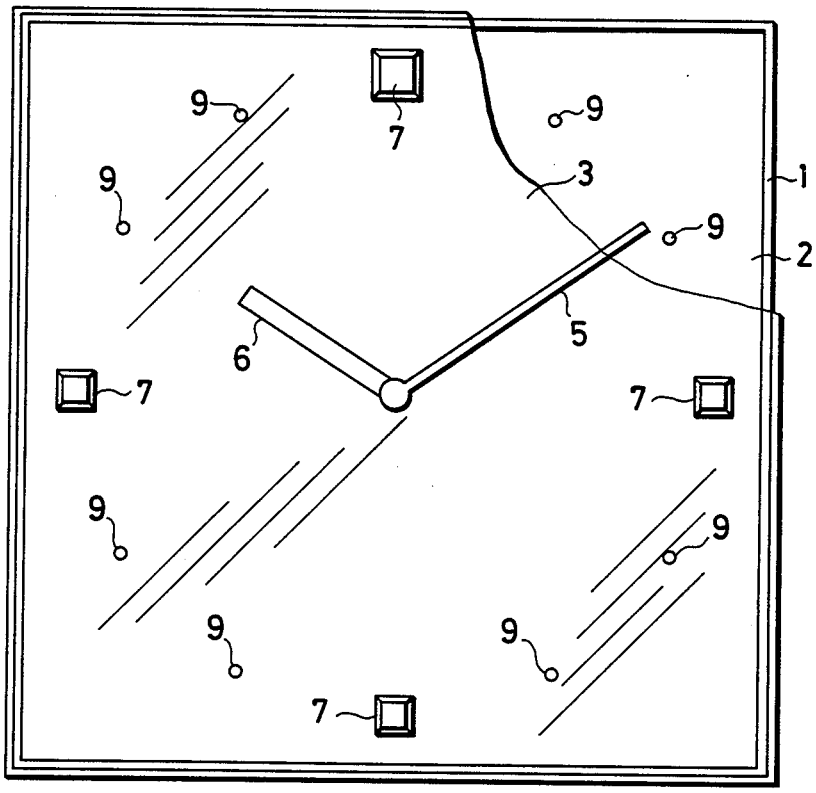
FIG. 1 is a front view of a clock to which the present invention is applied.

Referring to the drawings, preferred embodiments according to the present invention will be described.

Figure 2:
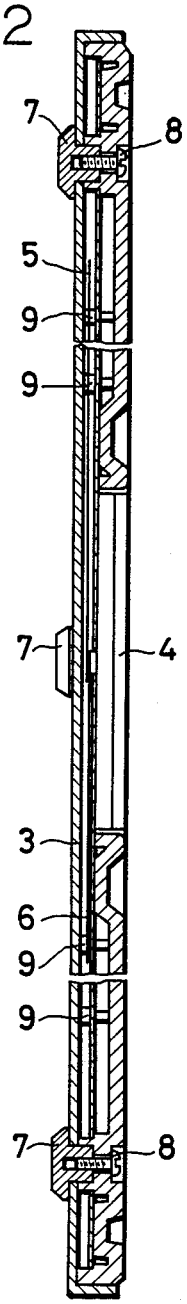
FIG. 2 is an enlarged cross-section of the clock.

As shown in FIGS. 1 and 2, a thin clock according to the present invention is constituted by an install or base plate 1 used also as a back frame, a dial 2, a transparent front cover 3, and a movement capsule 4. A minute hand 5 and an hour hand 6 driven by a well-known timepiece movement (not-shown) provided in the capsule 4 are disposed in a gap or space between the dial 2 and the front cover 3. Decorations 7 used as time reference members or scale are fixedly attached to the front surface of the front cover 3. Screws 8 inserted from the back side of the install plate 1 are screwed into back surfaces of the respective decorations 7 so that the front cover 3 and the install plate 1 are connected with each other through the dial 2 interposed therebetween.

Figure 3:
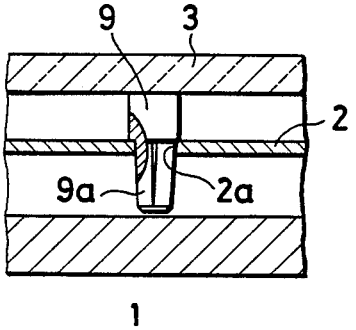
FIG. 3 is an enlarged cross-section of a main part of the clock.

As shown in FIG. 3, through holes **2*a* are provided in the dial 2 so that respective leg portions 9*a* of spacers in the form of pins 9 each having a shoulder portion are inserted into the through holes 2*a* respectively from the front surface of the dial 2. The respective upper ends or projections of the spacers 9 abut against the front cover 3 and the respective leg portions 9*a* of the spacers 9 abut against the install plate 1 at the bottom ends of the leg portions 9*a*. An axial split groove is formed in the leg portion of each spacer 9 to provide elastic force to open the leg portion outwards. The spacers 9 are provided on the visible peripheral portion of the front face of the dial 2 such that the spacers 9 do not prevent the hands 5 and 6 from turning and such that the spacers 9** are arranged to be used also as time reference members or time scale for the hands.

Even if the front cover 3 is subjected to be deformed due to a temperature or a pressure applied thereto in turning the hands, the gap or interval between the front cover 3 and the dial 2, and the gap or distance between the dial 2 and the install plate 1 are kept fixed, so that the dial 2 is never deformed.

Alternatively, the same effect as the above-mentioned effect can be obtained even when the respective front ends of the spacers 9 and the respective bottom ends of the leg portions **9*a* are made respectively to come close to the front cover 3 and the install plate 1 with slight clearances therebetween respectively such that the front ends of the spacers 9 are contactable with the back face of the front cover 3** to maintain a sufficient gap or space.

Figure 4:
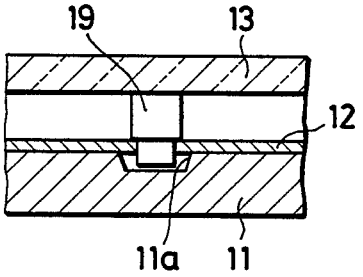
FIG. 4 is an enlarged cross-section of a main part of another embodiment.

FIG. 4 shows another embodiment which is arranged such that a dial 12 is bonded onto a front surface of an install plate 11 so as to prevent the dial 12 from being deformed. Namely, respective top ends of spacers in the form of a projection 19 planted in the dial 12 abut against a front cover 13 and respective bottom ends of the spacers 19 can abut against respective bottom surfaces of corresponding hollow portions or cavities **11*a* in the install plate 11**.

Figure 5:
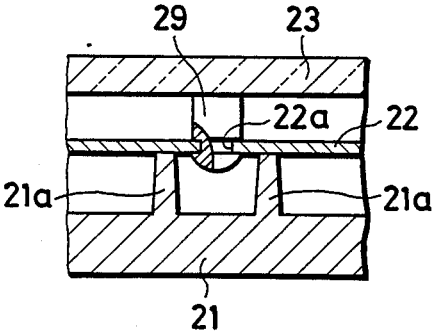
FIG. 5 is an enlarged cross-section of a main part of still another embodiment.

FIG. 5 shows a further embodiment, in which spacers 29 made of thermoplastics are planted in a dial 22 in such a manner that respective lower end portions of the spacers 29 are inserted into corresponding through holes **22*a* of the dial 22 and fused to be attached thereto. Respective upper end surfaces of the spacers 29 abut against a front cover 23 since the height of the spacer 29 substantially corresponds to the gap between the dial 22 and the front cover 23. A plurality of protrusions in the form of support posts 21***a* are formed on an install plate 21 in opposed relation to the spacers 29 to support the same and respective upper ends of the support posts 21*a* and 21*a* abut against a back surface of the dial 22. Therefore, the dial 22 can be prevented from being excessively deformed.

Figure 6:
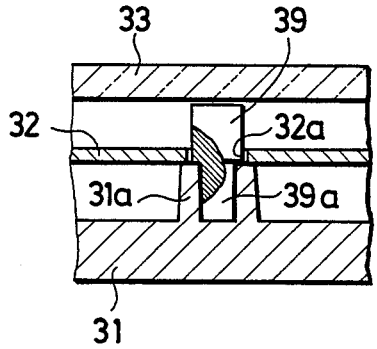
FIG. 6 is an enlarged cross-section of a main part of a further embodiment.

In an embodiment shown in FIG. 6, respective leg portions 39*a* of spacers 39 are inserted into corresponding cylindrical spacer holders 31*a* integrally formed with an install plate 31. Respective end surfaces of the holders 31*a* abut against a back surface of a dial 32, and the spacers 39 are passed through corresponding through holes 32*a* formed in the dial 32 and made to be opposed to an inner surface of a front cover 33.

Figure 7:
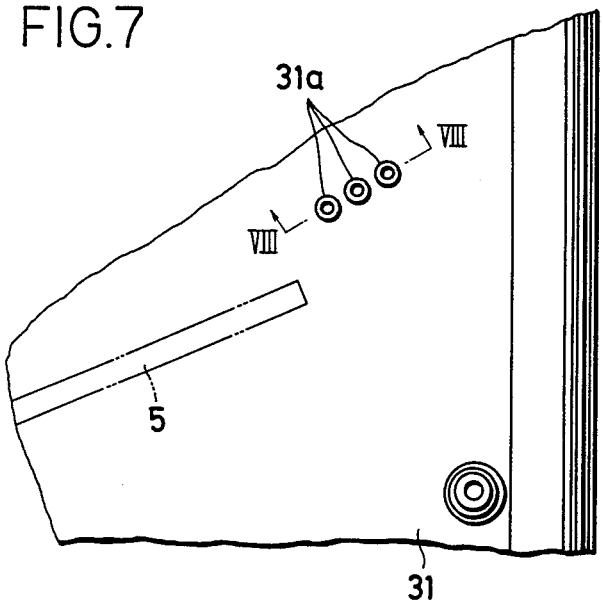
FIG. 7 is an enlarged front view of a main part of the install plate in a still further embodiment.
Figure 8:
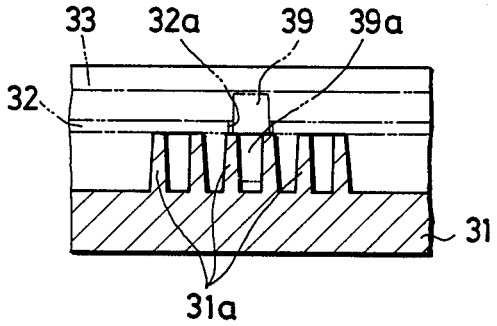
FIG. 8 is a cross-section along the line VIII—VIII in FIG. 7.

FIGS. 7 and 8 show an embodiment in which a plurality of the spacer holders 31*a* are radially aligned at each of time reference positions. The spacer 39 is selectively removably inserted in any of the spacer holders 31*a* at each of the time reference portions. In such an arrangement, the install plate 31 can be used in common for modifications in design or in radius on which reference members are arranged in a clock.

Figure 9:
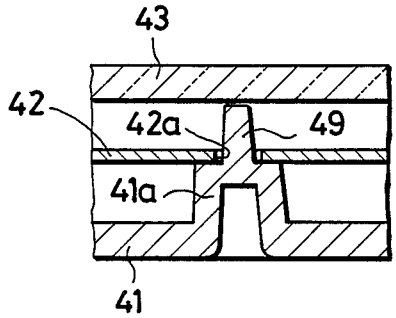
FIG. 9 is an enlarged cross-section of a main part of a further embodiment.

FIG. 9 shows an embodiment, in which protrusions 41*a* for supporting a back surface of a dial 42 is integrally formed on an install plate 41, and spacers 49 are projectingly integrally formed on the respective end surfaces of the protrusions 41*a*. The spacers 49 pass through corresponding through hole 42 bored in the dial 42 and made to be opposed to a front cover 43.

According to the thus arranged present invention, even if the front cover, the install plate, or the like, is subjected to be deformed due to a temperature, external force, or the like, the gap between the front cover and the dial is kept fixed by the spacers so as to prevent the hands from touching the inner surface of the front cover, to thereby prevent faults such as injury of the front cover due to touching by the hands, stopping of rotation of the hands, stopping of operation of the clock, and so on. Further, the spacers may be used also as reference members such as solid letters, resulting in unique aethetic impression in design of a clock.

What is claimed is:

1. In a clock comprising a capsule having a timepiece movement therein, an install plate for firmly supporting said capsule disposed thereon, a dial having a front face and time reference members on the front face, the dial being disposed in front of said install plate, a transparent front cover having a back face and being disposed in front of said dial to define a gap between the back face of the transparent front cover and the front face of the dial, and hands disposed in the gap and driven by said timepiece movement to move relative to the time reference members to indicate time; the improvement wherein said time reference members have a height substantially corresponding to said gap between said dial and said front cover so as to act as spacers for maintaining said gap.

2. A clock according to claim 1, wherein said spacers are fixedly attached to said dial, said spacers having legs passing through said dial, the respective tip ends of said legs being made to come close to or to abut against said install plate.

3. A clock according to claim 1, wherein said spacers are held by said install plate, the respective ends of said spacers passing through and projecting from said dial to come close to or to abut against the back face of said front cover.

4. A clock according to claim 3, including spacer holders formed on a front face of said install plate for holding said spacers to urge the spacers against a back face of said dial.

5. A clock according to claim 4, wherein said spacer holders are formed at each of positions corresponding to the time reference members along the radial direction so that each of said spacers is removably and selectively inserted in any of said spacer holders.

6. A clock according to claim 1, including projections integrally formed on said install plate so that said projections abut against a back face of said dial, said spacers being formed on respective ends of said projections so as to pass through said dial.

7. A clock comprising: a base plate having a front face; a timepiece movement disposed on the front face of the base plate; a dial having front and back faces and being disposed on the front face of the base plate; a transparent cover plate having a back face and being spaced apart a given distance from the dial to define a space between the back face of the cover plate and the front face of the dial; a clock hand disposed in the space and driven by the timepiece movement to move relative to the dial to indicate time; and spacer means disposed on a visible peripheral portion of the front face of the dial and protruding toward the back face of the cover plate such that the spacer means is contactable with the back face of the cover plate upon deformation of the dial and the cover plate to thereby maintain a sufficient space to allow free movement of the hand.

8. A clock according to claim 7; wherein the spacer means comprises a plurality of projections.

9. A clock according to claim 8; wherein the projections are arranged to define a time scale for the clock hand.

10. A clock according to claim 7; wherein the spacer means extend in the vicinity of the back face of the cover plate.

11. A clock according to claim 7; wherein the spacer means protrudes into contact with the back face of the cover plate.

12. A clock according to claim 8; wherein each projection comprises a pin secured to and vertically extending through the dial, a bottom end of the pin protruding against the front face of the base plate.

13. A clock according to claim 12; wherein the base plate has a plurality of cavities on the front face thereof to receive therein the bottom end of the respective pins.

14. A clock according to claim 7; including supporting means disposed between the back face of the dial and the front face of the base plate in opposed relation to the spacer means for supporting the spacer means through the dial.

15. A clock according to claim 14; wherein the supporting means comprises a plurality of protrusions integrally formed on the front face of the base plate.

16. A clock according to claim 15; wherein the spacer means comprises a plurality of projections corresponding to respective ones of the protrusions.

17. A clock according to claim 16; including coupling means for coupling each projection to each corresponding protrusion through the dial.

18. A clock according to claim 17; wherein the coupling means comprises a leg vertically downwardly extending from the projection, and a hollow provided in the protrusion for receiving therein the leg.

19. A clock according to claim 16; wherein each projection and its corresponding protrusion are formed integral with each other.

20. A clock according to claim 14; wherein the supporting means comprises a plurality of sets of protrusions disposed circumferentially on the front face of the base plate, each set of protrusions being radially aligned on the front face of the base plate.

* * * * *